US009381414B1

(12) United States Patent
Gatton et al.

(10) Patent No.: US 9,381,414 B1
(45) Date of Patent: Jul. 5, 2016

(54) APPARATUS, SYSTEM AND METHODS FOR IMPROVED BAG TOSS

(71) Applicants: Jacob Gatton, Forest City, IA (US); Steven Monk, Forest City, IA (US)

(72) Inventors: Jacob Gatton, Forest City, IA (US); Steven Monk, Forest City, IA (US)

( * ) Notice: Subject to any disclaimer, the term of this patent is extended or adjusted under 35 U.S.C. 154(b) by 0 days.

(21) Appl. No.: 14/553,678

(22) Filed: Nov. 25, 2014

Related U.S. Application Data

(60) Provisional application No. 61/924,821, filed on Jan. 8, 2014.

(51) Int. Cl.
*A63B 63/00* (2006.01)
*A63B 67/06* (2006.01)

(52) U.S. Cl.
CPC ..... *A63B 67/06* (2013.01); *A63B 63/00* (2013.01); *A63B 2210/50* (2013.01)

(58) Field of Classification Search
CPC ..... A63B 67/06; A63B 2210/50; A63B 63/00
USPC ..... 273/398–402, 285
See application file for complete search history.

(56) References Cited

U.S. PATENT DOCUMENTS

| | | | | | |
|---|---|---|---|---|---|
| 3,837,650 | A * | 9/1974 | Haney | A63F 9/001 | 273/402 |
| 4,943,065 | A * | 7/1990 | DeLapa | A63B 67/06 | 273/402 |
| 5,318,307 | A * | 6/1994 | Bouchard | A63B 67/06 | 273/271 |
| 5,332,230 | A * | 7/1994 | Benedict | A63B 67/06 | 273/400 |
| D375,530 | S * | 11/1996 | Rudd | D21/303 | |
| 5,765,832 | A * | 6/1998 | Huff | A63B 63/08 | 273/354 |
| 5,909,877 | A * | 6/1999 | Bour | A63B 67/06 | 273/402 |
| 6,244,598 | B1 * | 6/2001 | Conville | A63B 63/00 | 273/402 |
| 7,607,666 | B1 * | 10/2009 | Studier | A63B 63/00 | 116/222 |
| 8,807,569 | B1 * | 8/2014 | Davis | A63B 67/06 | 273/371 |
| 9,095,754 | B2 * | 8/2015 | Cerpok | A63B 63/004 | |
| 2014/0091526 | A1 * | 4/2014 | Nally | A63B 63/08 | 273/402 |

* cited by examiner

*Primary Examiner* — Mark Graham
(74) *Attorney, Agent, or Firm* — Michael A. Bondi; Moss & Barnett

(57) ABSTRACT

The present disclosure addresses apparatus, systems and methods for improvement of a gaming surface. Exemplary embodiments of the present system comprise a playing surface which comprises multiple planks which may be folded in relation to one another.

16 Claims, 6 Drawing Sheets

APPARATUS, SYSTEM AND METHODS FOR IMPROVED BAG TOSS

CROSS-REFERENCE TO RELATED APPLICATIONS

This application claims priority to U.S. Application No. 61/924,821, which was filed on Jan. 8, 2014, the contents of which are hereby incorporated by reference.

FIELD OF THE INVENTION

The present system relates to an improved platform for gaming. More particularly, the invention relates to a bag toss system.

BRIEF SUMMARY OF THE INVENTION

Embodiments of the present invention relate to systems and methods for the storage and transport of a gaming surface.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

An embodiment of the invention is directed to a bag toss board system that includes at least one item to be tossed and a playing surface. The playing surface includes a plurality of planks that are pivotally attached to each other. The plurality of planks enables the playing surface to be placed in a use configuration and a storage configuration. A size of the playing surface is smaller in the storage configuration than in the use configuration. At least one of the planks has an opening formed therein that is adapted to receive the item to be tossed.

Another embodiment of the invention is directed to a method of fabricating a bag toss board system. A first plank is operably attached to a second plank with a first hinge. The first plank is operably attached to a third plank with a second hinge. At least one of the first plank, the second plank and the third plank has an opening formed therein.

The first plank, the second plank and the third plank are positioned in a use configuration to form a substantially planar playing surface. The first plank, the second plank and the third plank are retained in the use configuration by engaging the first plank, the second plank and the third plank with an end bracket. The second plank and the third plank are moved with respect to the first plank to a storage configuration. A size of the playing surface is smaller in the storage configuration than in the use configuration.

BRIEF DESCRIPTION OF THE DRAWINGS

Embodiments are described in detail below with reference to the attached drawing figures, wherein.

DETAILED DESCRIPTION

The present apparatus, systems and methods disclose a system which addresses flaws in the prior art. For brevity, embodiments will be discussed in reference to the "system," though as one of skill in the art would be readily aware, this can comprise various aspects of the disclosed apparatus and methods. The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although certain ordered terms may be used herein to connote different elements of methods employed, the terms should not be interpreted as implying any particular order among or between various steps herein disclosed unless and except when the order of individual steps is explicitly described.

Figure 1:
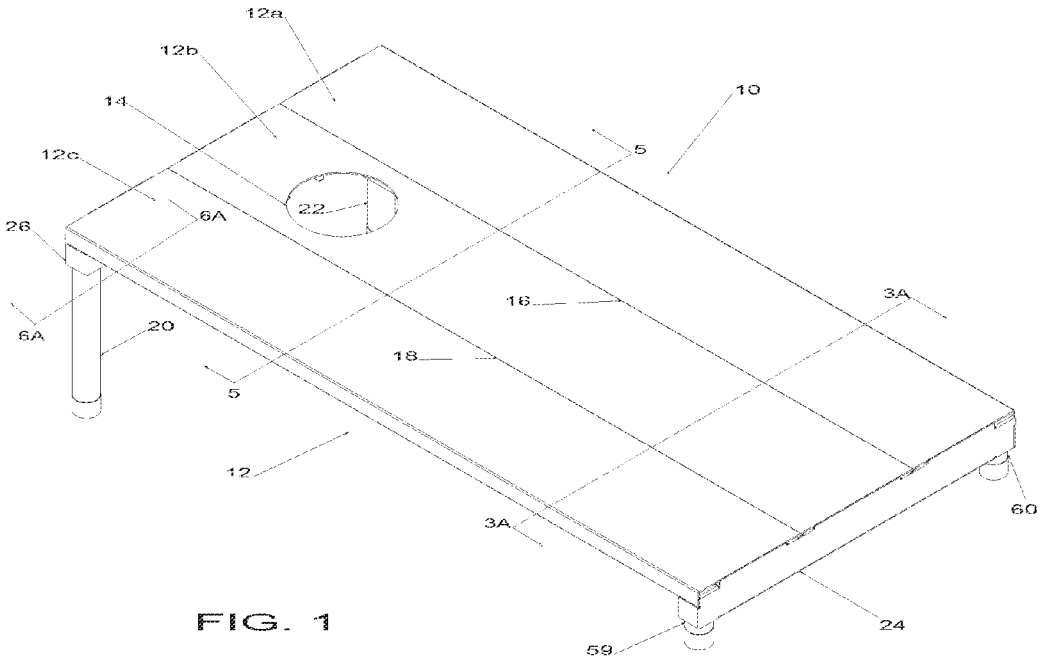
FIG. 1 is a perspective view of a bag toss system according to an embodiment of the invention where the bag toss system is in a use configuration.

Referring to the drawings in general, and initially to FIG. 1 in particular, exemplary embodiments of the present apparatus, system and methods (hereinafter the "system") 10 comprise a playing surface 12 having at least one opening 14.

The opening 14 is formed with a diameter that is larger than the item being tossed such that when the item is accurately tossed, the item falls through the opening 14. In certain embodiments, the opening 14 has a diameter of between about 2 inches and about 6 inches. While the opening 14 is illustrated as being substantially circular, it is possible for the opening 14 to be formed with alternate shapes.

The item that is used in conjunction with the invention may assume a variety of forms. In certain embodiments, the item has an outer enclosure in which is placed a fill material. The fill material utilized is less than the amount needed to completely fill the outer enclosure so that the outer enclosure is deformable such as when landing on the playing surface 12. Such a configuration minimizes bouncing of the item after landing on the playing surface 12. This configuration also facilitates sliding of the item along the playing surface 12 after the item lands on the playing surface 12. In certain embodiments, the item may be identified as a bean bag. In other embodiments, the item may be relatively rigid such that the item bounces after landing on the playing surface 12.

The playing surface 12 is fabricated in a plurality of sections that enable a size of the playing surface 12 to be reduced when the invention is stored after use. In certain embodiments, the playing surface 12 includes a plurality of planks 12*a*, 12*b*, 12*c*, which define joints 16, 18 therebetween.

The central plank 12*b* may have a width that is greater than the outer planks 12*a*, 12*c*. Using such a configuration facilitates folding of the planks 12*a*, 12*b*, 12*c* into a compact configuration, as illustrated in FIG. 3B, as described in more detail below.

In certain embodiments, the playing surface 12 may be substantially planar. The playing surface 12 may have a generally elongated configuration with a length that is greater than a width. In certain embodiments, the length is between about 2 feet and about 4 feet. In certain embodiments, the width is between about 1 foot and about 3 feet.

Figure 2:
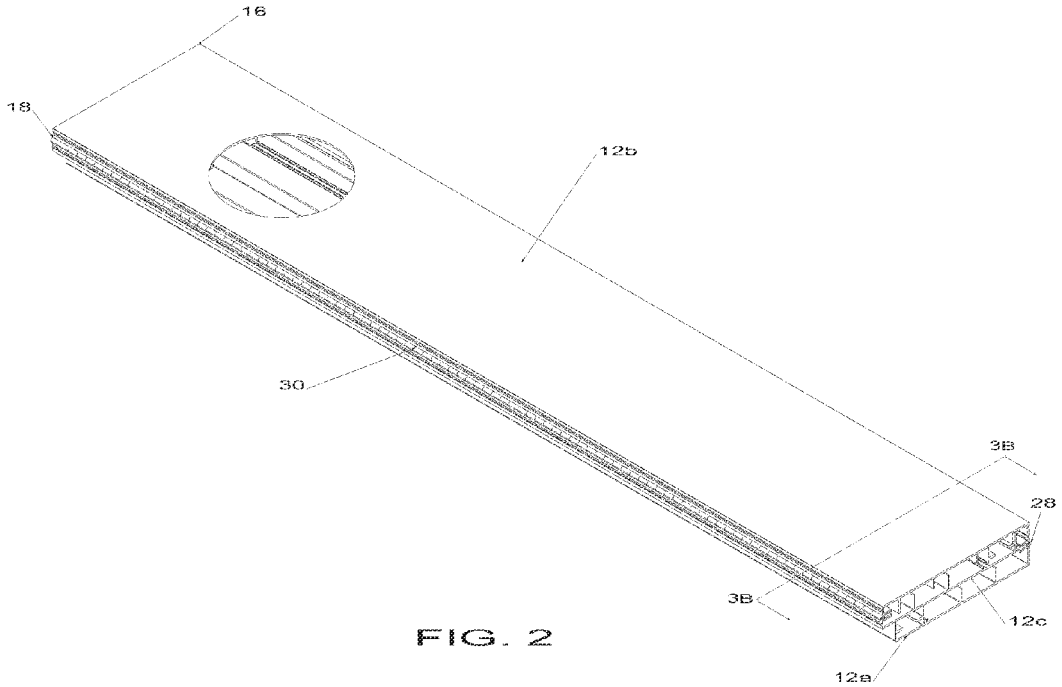
FIG. 2 is a perspective view of the bag toss system in a storage configuration.

As is shown in FIG. 2, the playing surface 12 includes at least one joint 16, 18 allowing the playing surface 12 to fold or otherwise reduce in size into a more compact arrangement for storage and transportation. In certain exemplary embodiments, this is achieved by way of a hinge or hinges 28, 30. Upon folding of the system according to the methods described herein, the system's overall size has been reduced for improved transport and storage.

The game system 10 includes at least one leg 20 and at least one end plate 24. In the embodiment of FIG. 1, the game system 10 includes two longer legs 20, 22, two shorter legs 59, 60, and two end plates 24, 26. As would be apparent to one of skill in the art, other configurations are possible.

In exemplary embodiments, the apparatus and system allow the user of the playing surface 12 to quickly and easily remove the legs 20, 22, 59 and 60 and fold the playing surface 12 into a stacked set of planks. In certain embodiments, the apparatus further comprises a snap-on handle or nylon carrying case (not shown), which can aid in the transport of the playing surface 12.

Figure 3A:
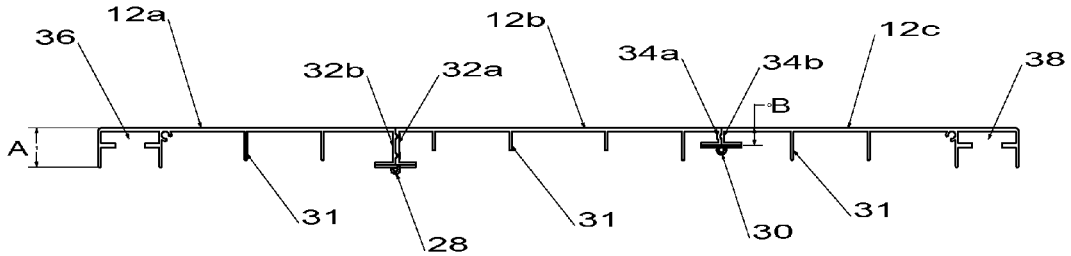
FIG. 3A is a sectional view of the bag toss system in the use configuration that is taken along a line 3A-3A in FIG. 1.
Figure 3B:
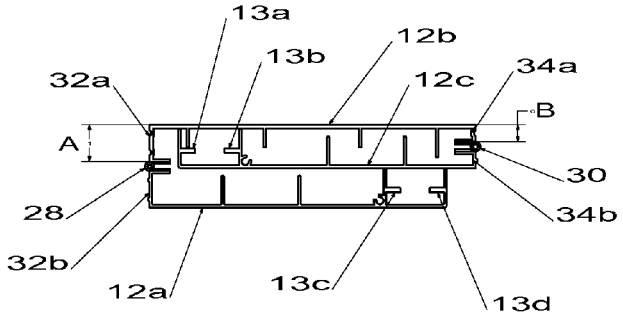
FIG. 3B is a sectional view of the bag toss system in the storage configuration that is taken along a line 3B-3B in FIG. 2.
Figure 4A:
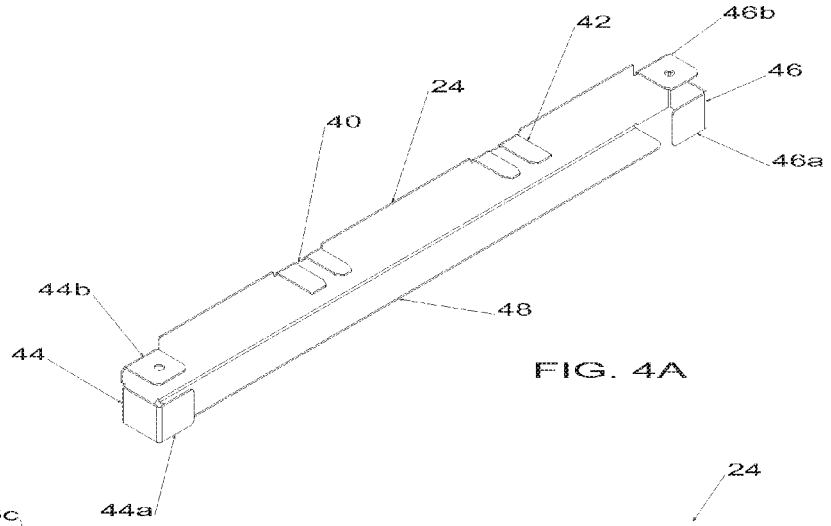
FIG. 4A is a perspective view of an end plate for the bag toss system.
Figure 4B:
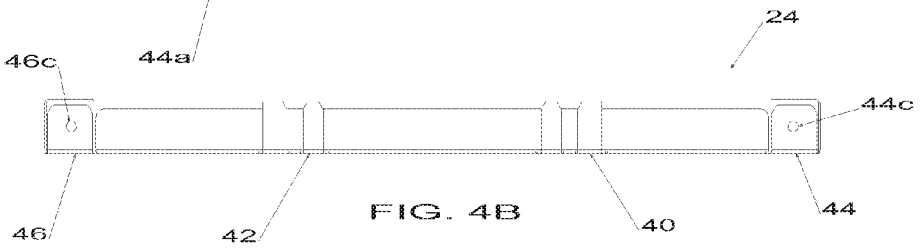
FIG. 4B is a top view of the end plate.
Figure 4C:
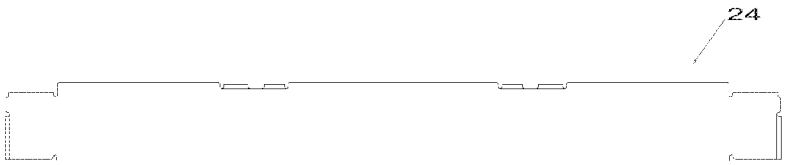
FIG. 4C is a back view of the end plate.
Figure 4E:
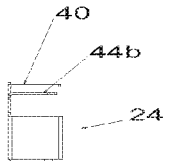
FIG. 4E is an end view of the end plate.
Figure 4D:
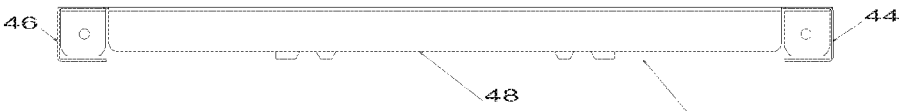
FIG. 4D is a bottom view of the end plate.

Turning to the system's operation in more detail, in certain embodiments, such as that shown in FIGS. 3A-3B, the hinges 28, 30 are separated from the face of the playing surface 12 on the underside by a plurality of spacers 32*a*, 32*b*, 34*a*, 34*b*. These spacers 32, 34 are typically substantially perpendicular from the playing surface 12, and in certain embodiments can be extruded with the aluminum of the playing surface planks 12*a*, 12,*b*, 12*c*, though other means and materials are possible.

Forming the spacers 32*a*, 32*b*, 34*a*, 34*b* with different heights enables the planks 12*a*, 12*b*, 12*c* to be substantially parallel to each other when in the storage configuration FIG. 3B.

In certain exemplary embodiments, as shown in FIG. 3B, one or more of the planks 12*a*, 12*c* may further comprise a plurality of clamping tabs 13*a*, 13*b*, 13*c*, 13*d* extruded in the two outer planks 12*a*, 12*c*. The clamping tabs 13*a*, 13*b*, 13*c*, 13*d* are adapted to receive the legs (as discussed herein in relation to FIGS. 6 A-6 B).

FIGS. 3A-3B also depict an embodiment of the present system which further comprises leg attachment portions 36, 38 for the outermost planks 12*a*, 12*c*. In certain embodiments, the legs to the device are removably attached to these portions 36, 38, as is described further in relation to FIGS. 5, 6A and 6B. In exemplary embodiments of the present system, a user may store the legs inside the folded apparatus.

In certain exemplary embodiments, the plurality of paired spacers 32*a*, 32*b*, 34*a*, 34*b* may be of unequal lengths between the pairs. In these embodiments, the hinges 28, 30 are thereby positioned to operate at different distances A, B from the playing surface, so as to facilitate substantially parallel folding of the planks, as is shown in FIG. 3B to facilitate a compact and substantially aligned folding position for the planks 12*a*, 12*b*, 12*c*.

FIGS. 3A and 3B show stiffening ribs 31 added to strengthen the planks 12*a*, 12*b*, 12*c* to more closely imitate the game play on a wooden version of the game. The ribs 31 may be formed with a height, width and spacing based upon a variety of factors such as the thickness of the planks 12*a*, 12*b*, 12*c*.

FIGS. 4A-4E depict various embodiments of an end plate. In this embodiment, the end plate 24 can be composed of formed sheet metal, injection-molded plastic, or another building material as would be apparent to one of skill in the art. In various embodiments, the end plate can further comprise support tabs 40, 42, regions adapted to receive the leg attachment portions of the outermost planks 44, 46, and a support region or regions 48.

The end plate cap 24 provides additional stability and rigidity to the playing surface, and can be used to lock the planks 12*a*, 12*b*, 12*c* in a planar configuration. In these embodiments, the regions adapted to receive the leg attachment portions of the outermost planks 44, 46 may comprise regions 44*a*, 46*a* adapted to fold around the support legs and leg mounting tabs 44*b*, 46*b*, which may further comprise regions adapted to receive a bolt, such as a carriage bolt 44*c*, 46*c* or a threaded weld stud.

Figure 5:
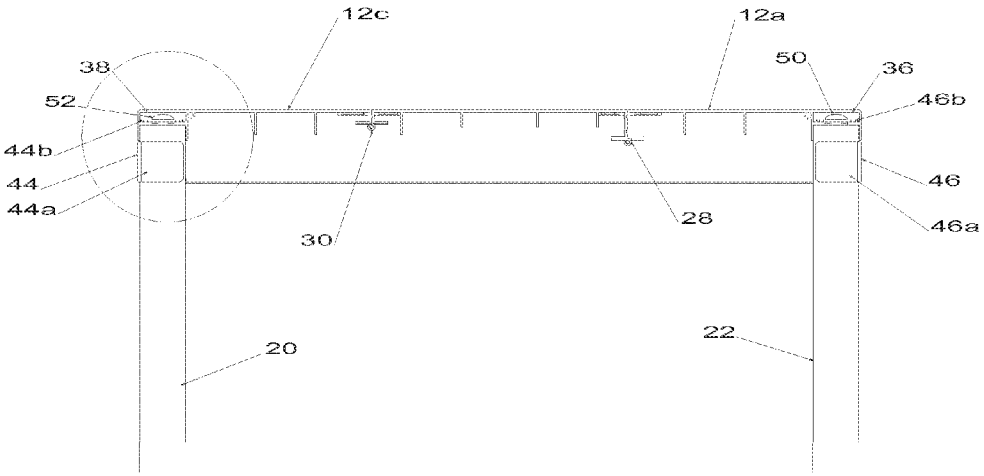
FIG. 5 is a sectional view of the bag toss system in the use configuration that is taken along a line 5-5 in FIG. 1.

As is shown in FIG. 5, carriage bolts or machine screws 52, 50 can be used to affix the legs 20, 22 to the planks 12*a*, 12*c* by way of the leg attachment portions of the outermost planks 44, 46. In these embodiments, the leg mounting tabs 44*b*, 46*b* may be utilized to secure the carriage bolts, and the regions 44*a*, 46*a* adapted to fold around the support legs 20, 22 are also utilized to provide additional support. A similar mechanism may be used for attaching the legs 59, 60 to the planks 12*a*, 12*c*.

Figure 6B:
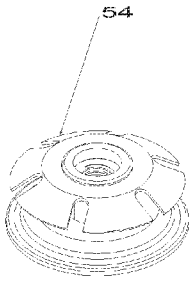
FIG. 6B is a perspective view of threaded tube insert for use in conjunction with the leg.
Figure 6A:
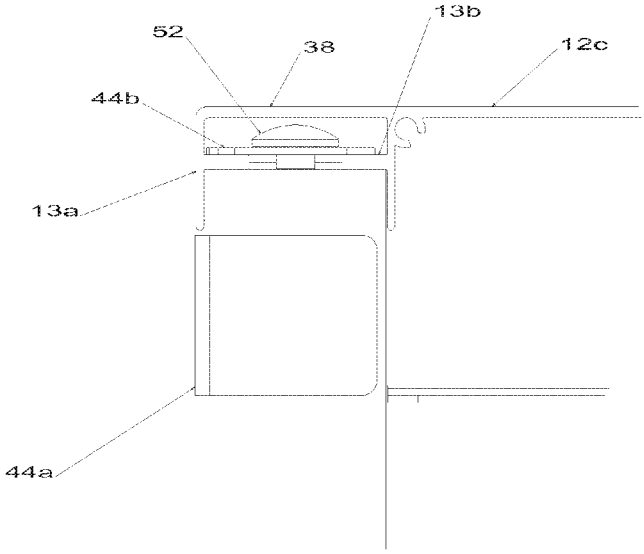
FIG. 6A is an enlarged sectional view illustrating attachment of a leg to a playing surface that is taken along a line 6A-6A in FIG. 1.

FIGS. 6A-6B provide further views of the embodiment of FIG. 5. FIG. 6B depicts the threaded tube insert 54, while FIG. 6A depicts one corner of the playing surface in greater detail, showing the carriage bolt or machine screw 52 inserted into the threaded tube insert 54, as well as supportive clamping tabs 13*a*, 13*b* and leg mounting tab 44*b*, featuring a receiving region (not shown).

In these exemplary embodiments, the threaded tube insert 54 functions to provide a threaded hole in the end of a leg (such as shown as 20, 22 in FIG. 1) or other attachable component for attachment onto the carriage bolt or machine screw 52. In further embodiments, folding brackets may be installed so as to facilitate the folding of the legs so as to further facilitate the ease of disassembly.

The longer legs 20, 22 may be formed with a length that is greater than the shorter legs 59, 60 so that the playing surface 12 may be oriented at an angle with respect to a ground surface on which the playing surface 12 is placed. Such a configuration enhances the ability to toss the item into the opening 14. In certain embodiments, an angle of the playing surface 12 is up to about 45 degrees. In other embodiments, the angle of the playing surface 12 is between about 10 degrees and about 30 degrees.

In further alternative embodiments, legs of various lengths may be mounted at all four corners. In certain alternative embodiments, the legs may be of adjustable length, as is well known in the art, and two playing surfaces may be adjoined to one another lengthwise, to provide a further playing surface, for example for the game "beer pong." The tables could also be used individually as a camping table or for other purposes. A removable plug/cover for the hole in the middle plank would enhance the use as tables.

Figure 7:
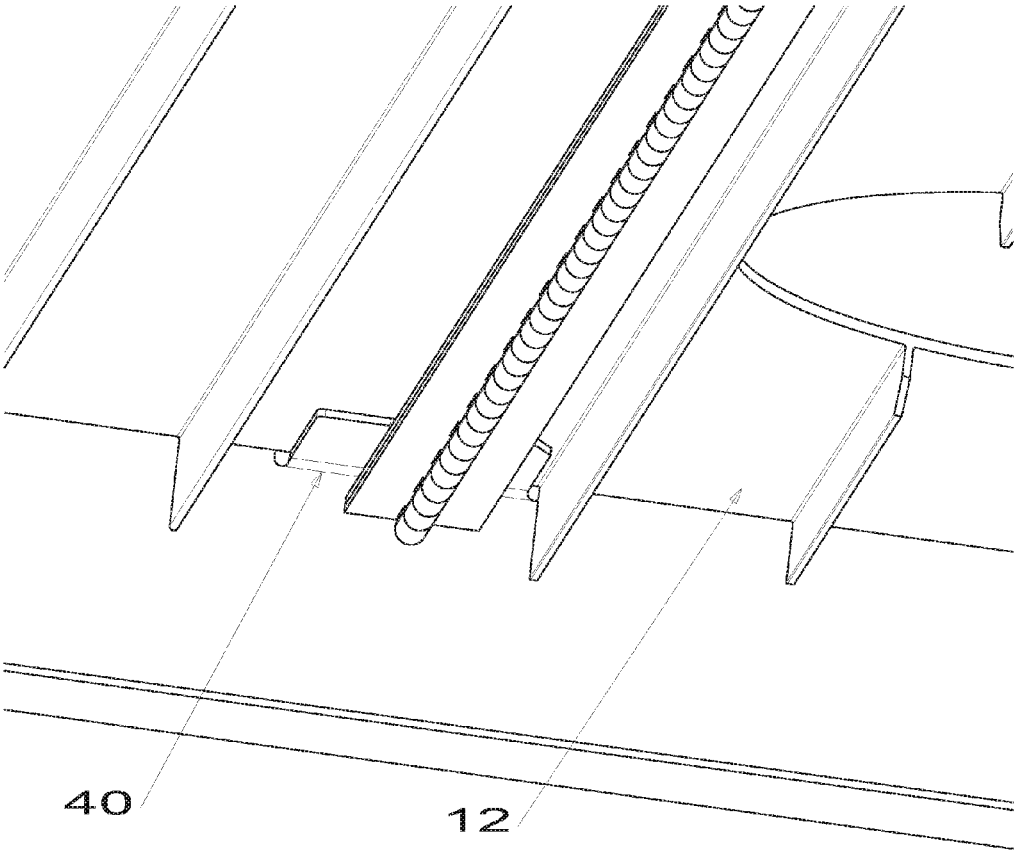
FIG. 7 is a lower perspective view of the bag toss system.

As is depicted in FIG. 7, the support tabs 40 in certain embodiments extends on the underside of the playing surface 12 so as to be placed in the gap formed by the spacers (as shown as 32*a*, 32*b*, 34*a*, 34*b* in FIGS. 3A-3B).

Figure 8:
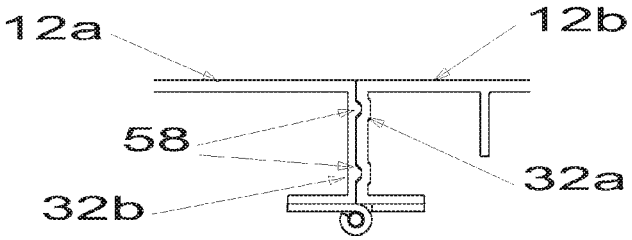
FIG. 8 is an enlarged sectional view of the bag toss system in the use configuration.

Certain embodiments further comprise a means of aligning the adjoining edges of the planks, as is shown in FIG. 8. In these embodiments, tongue and groove means 58, for example, can be utilized.

It is to be understood that the specific embodiments of the present invention that are described herein are merely illustrative of certain applications of the principles of the present invention. It will be appreciated that, although exemplary embodiments of the present invention have been described in detail for purposes of illustration; various modifications may be made without departing from the spirit and scope of the invention. Therefore, the invention is not to be limited except as by the appended claims.

The invention claimed is:

1. A bag toss board system comprising:

at least one item to be tossed;

a playing surface further comprising a plurality of planks that are pivotally attached to each other, wherein the plurality of planks comprises a first plank, a second plank and a third plank, wherein a first hinge operably attaches the first plank and the second plank and wherein a second hinge operably attaches the first plank and the third plank, wherein the plurality of planks enable the playing surface to be placed in a use configuration and a storage configuration, wherein a size of the playing surface is smaller in the storage configuration than in the use configuration and wherein at least one of the planks has an opening formed therein that is adapted to receive the item to be tossed;

a plurality of first spacers that attach the first hinge to the first plank and the second plank; and a plurality of second spacers that attach the second hinge to the first plank and the third plank, wherein each of the plurality of first spacers has a first height, wherein each of the plurality of second spacers has a second height and wherein the first height is greater than the second height.

2. The bag toss board system of claim 1, wherein the second height is approximately one half of the first height.

3. The bag toss board system of claim 1, wherein when the playing surface is in the storage configuration, the second plank and the third plank are substantially parallel to the first plank.

4. The bag toss board system of claim 1, wherein each of the plurality of planks has at least one reinforcing rib extending therefrom.

5. The bag toss board system of claim 1, and further comprising:

at least one first leg attached to the playing surface proximate a first end thereof; and at least one second leg attached to the playing surface proximate a second end thereof, wherein the at least one first leg has a length that is greater than the at least one second leg.

6. A bag toss board system comprising:

at least one item to be tossed;

a playing surface further comprising a plurality of planks that are pivotally attached to each other, wherein the plurality of planks enable the playing surface to be placed in a use configuration and a storage configuration, wherein a size of the playing surface is smaller in the storage configuration than in the use configuration and wherein at least one of the planks has an opening formed therein that is adapted to receive the item to be tossed; and at least one end bracket that is capable of engaging the playing surface to retain the playing surface in the use configuration, wherein the at least one end bracket comprises:

a plurality of support tabs that are capable of engaging the playing surface; and at least one leg mounting mechanism that is capable of receiving a portion of at least one leg to operably attach the at least one leg to the playing surface.

7. The bag toss game system of claim 6, wherein the at least one leg comprises a threaded fastener that is capable of releasably securing the at least one leg to the playing surface.

8. The bag toss game system of claim 6, wherein the playing surface comprises two clamping tabs attached thereto, wherein the clamping tabs define a receiving region that is adapted to receive a portion of the at least one end bracket.

9. A method of fabricating a bag toss board system, wherein the method comprises:

operably attaching a first plank to a second plank with a first hinge, wherein the first hinge is attached to the first plank and the second plank with a plurality of first spacers;

operably attaching the first plank to a third plank with a second hinge, wherein at least one of the first plank, the second plank and the third plank has an opening formed therein, wherein the second hinge is attached to the first plank and the third plank with a plurality of second spacers, wherein each of the plurality of first spacers has a first height, wherein each of the plurality of second spacers has a second height and wherein the first height is greater than the second height;

positioning the first plank, the second plank and the third plank in a use configuration to form a substantially planar playing surface;

retaining the first plank, the second plank and the third plank in the use configuration by engaging the first plank, the second plank and the third plank with an end bracket; and moving the second plank and the third plank with respect to the first plank to a storage configuration, wherein a size of the playing surface is smaller in the storage configuration than in the use configuration.

10. The method of claim 9, wherein the second height is approximately one half of the first height.

11. The method of claim 9, wherein when the first plank, the second plank and the third plank are in the storage configuration, the second plank and the third plank are substantially parallel to the first plank.

12. The method of claim 9, and further comprising attaching at least one reinforcing rib to the first plank, the second plank and the third plank.

13. The method of claim 9, and further comprising:

attaching at least one first leg to the playing surface proximate a first end thereof; and attaching at least one second leg to the playing surface proximate a second end thereof, wherein the at least one first leg has a length that is greater than the at least one second leg.

14. The method of claim 13, wherein the at least one end bracket comprises:

a plurality of support tabs that are capable of engaging the playing surface; and at least one leg mounting mechanism that is capable of receiving a portion of at least one leg to operably attach the at least one leg to the playing surface.

15. The method of claim 13, wherein the at least one leg comprises a threaded fastener that is capable of releasably securing the at least one leg to at least one of the first plank, the second plank and the third plank.

16. The method of claim 13, wherein the playing surface comprises two clamping tabs attached thereto, wherein the clamping tabs define a receiving region that is adapted to receive a portion of the at least one end bracket.

* * * * *